US007714240B1

(12) United States Patent
Roesler et al.

(10) Patent No.: US 7,714,240 B1
(45) Date of Patent: May 11, 2010

(54) MICROFABRICATED TRIGGERED VACUUM SWITCH

(75) Inventors: Alexander W. Roesler, Tijeras, NM (US); Joshua M. Schare, Albuquerque, NM (US); Kyle Bunch, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 1267 days.

(21) Appl. No.: 11/231,915

(22) Filed: Sep. 21, 2005

(51) Int. Cl.
*H01H 57/00* (2006.01)

(52) U.S. Cl. ..... 200/181; 313/155; 315/111.41; 361/2

(58) Field of Classification Search ..... 200/181; 313/155, 231.11, 231.31; 315/111.41, 338; 361/2, 8
See application file for complete search history.

(56) References Cited

U.S. PATENT DOCUMENTS

| | | | |
|---|---|---|---|
| 5,739,637 | A | 4/1998 | Boettcher |
| 6,385,031 | B1 | 5/2002 | Lerche et al. |
| 6,796,870 | B2 | 9/2004 | Nakamoto |
| 6,803,725 | B2 | 10/2004 | Jin |
| 6,851,370 | B2 | 2/2005 | Reynolds et al. |
| 6,891,320 | B2 | 5/2005 | Nakamoto |
| 2003/0036332 | A1 | 2/2003 | Talin et al. |
| 2004/0160726 | A1 | 8/2004 | Lerche et al. |

OTHER PUBLICATIONS

L. M. Earley, et al, "Low-Cost, 3 KV, Triggered, Stripline, Surface-Discharge Switch" Digest of Technical Papers, Eighth IEEE International Pulsed Power Conference, 2003, pp. 340-342.
M.P. Siegal, et al, "Diamond and Diamond-Like Carbon Films for Advanced Electronic Applications," Sandia Report, SAND96-0516, Mar. 1996.
Thomas A. Baginski, et al, "A High-Voltage Single-Shot Switch Implemented with a MOSFET Current Source and Avalanche Diode," IEEE Transactions on Industrial Electronics, vol. 44, No. 2, Apr. 199, pp. 167-172.
Y.Y. Wei et al, "Direct fabrication of carbon nanotube circuits by selective area chemical vapour deposition on pre-patterned structures," Nanotechnology 11, (2000), pp. 61-64.
M.E. Read et al, "Carbon Nanotube-Based Cathodes for Microwave Tubes", Proceedings of the 2001 Particle Accelerator Conference, Chicago, pp. 1026-1028.

(Continued)

*Primary Examiner*—Michael A Friedhofer
(74) *Attorney, Agent, or Firm*—John P. Hohimer

(57) ABSTRACT

A microfabricated vacuum switch is disclosed which includes a substrate upon which an anode, cathode and trigger electrode are located. A cover is sealed over the substrate under vacuum to complete the vacuum switch. In some embodiments of the present invention, a metal cover can be used in place of the trigger electrode on the substrate. Materials used for the vacuum switch are compatible with high vacuum, relatively high temperature processing. These materials include molybdenum, niobium, copper, tungsten, aluminum and alloys thereof for the anode and cathode. Carbon in the form of graphitic carbon, a diamond-like material, or carbon nanotubes can be used in the trigger electrode. Channels can be optionally formed in the substrate to mitigate against surface breakdown.

30 Claims, 13 Drawing Sheets

OTHER PUBLICATIONS

N.L. Rupesinghe, et al, "Field emission vacuum power switch using vertically aligned carbon nanotubes," J.Vac. Sci. Technol. B, vol. 21, No. 1, Jan./Feb. 2003, pp. 338-343.

Y. Tzeng et al, "Fabrication and Characterization of Non-Planar High-Current-Density Carbon-Nanotube Coated Cold Cathodes", Diamond and Related Materials 12 (2003) pp. 442-445.

W.J. Yu et al, "A stable high power carbon nanotube field-emitter device," Diamond and Related Materials 13 (2004) pp. 1017-1021.

Harish Manohara, et al, "Field Emission Testing of Carbon Nanotubes for THz Frequency Vacuum Micro-Tube Sources", Proc. of SPIE, vol. 5343, 2004, pp. 227-234.

D.C. Cox et al, "Thermionic Emission from Defective Carbon Nanotubes", Appl. Phys. Lett., vol. 85, No. 11, (2004) pp. 2065-2067.

MICROFABRICATED TRIGGERED VACUUM SWITCH

GOVERNMENT RIGHTS

This invention was made with Government support under Contract No. DE-AC04-94AL85000 awarded by the U.S. Department of Energy. The Government has certain rights in the invention.

FIELD OF THE INVENTION

The present invention relates in general to triggerable high-voltage vacuum switches, and in particular to a microfabricated triggered vacuum switch which can be used to switch high voltages up to several kiloVolts or more, and which can operate repeatedly.

BACKGROUND OF THE INVENTION

High-voltage switches with a high peak current capability and precise, repeatable performance are needed for operating capacitive discharge units (CDUs) for many applications including the initiation of explosives, the triggering of airbags and camera flash units, etc. Current high-voltage vacuum switches require piece-part assembly which makes them relatively expensive for many applications. Additionally, piece-part assembly results in variations in assembly which can affect the operating characteristics of the devices. What is needed is a way of batch fabricating high-voltage vacuum switches to reduce the cost and improve the reliability of electrical vacuum switches.

The present invention addresses this need for batch fabricating high-voltage vacuum switches by providing an electrical vacuum switch apparatus that comprises an anode, a cathode and a trigger electrode which can all be microfabricated on the same substrate. A completed vacuum switch can then be formed according to the present invention by attaching a cover over the substrate under vacuum to provide a vacuum environment wherein the anode, cathode and trigger electrode are located.

An advantage of the electrical vacuum switch apparatus of the present invention is that a relatively large number (up to hundreds or more) of individual devices can be batch fabricated on a common substrate without piece part assembly.

Another advantage of the electrical vacuum switch apparatus of the present invention is that various types of carbon materials can be used in the trigger electrode to provide electron emission for initiating a vacuum arc therein including graphitic carbon, diamond-like materials, and carbon nanotubes.

Yet another advantage of the electrical vacuum switch apparatus of the present invention is that one or more channels can be formed extending below a surface of the substrate whereon the anode and cathode are located to prevent surface breakdown on the substrate during operation of the device.

Still another advantage is that a metal cover can be used to trigger the vacuum arc in the electrical vacuum switch apparatus of the present invention, and to channel at least a portion of the arc.

These and other advantages of the present invention will become evident to those skilled in the art.

SUMMARY OF THE INVENTION

The present invention relates to an electrical vacuum switch apparatus (also referred to herein as a vacuum switch) which comprises a substrate; an anode and a cathode spaced apart on a surface of the substrate; a trigger electrode disposed between the anode and the cathode; and a cover sealed over the substrate to provide an evacuated region wherein the anode, the cathode and the trigger electrode are exposed to a vacuum environment.

In certain embodiments of the present invention, the apparatus can further comprise one or more channels extending below the surface of the substrate between the anode and the cathode. Such channels can extend partway or all the way around the anode, or cathode, or both to prevent surface breakdown in the device. Generally, each channel has a high aspect ratio, with the channel depth being greater than the width thereof.

The substrate can comprise an electrically-insulating material such as glass, silica, quartz, diamond, alumina or ceramic. In some embodiments of the present invention, the substrate can comprise silicon, with an electrically-insulating layer being provided over an upper surface of the silicon substrate beneath the anode and cathode. The anode and the cathode can comprise a metal or metal alloy (e.g. comprising niobium, molybdenum, copper, tungsten, aluminum, etc.).

The trigger electrode is preferably repeatedly pulsable to provide an electrical conduction path (also termed a vacuum arc, or a current discharge path) which can occur at least partially in an evacuated region and in some instances partially in a metal cover between the anode and the cathode. The trigger electrode can comprise a resistive material such as carbon which can generate sparks (i.e. a plasma or plasma discharge) in response to an electrical current flowing therethrough. Alternately, the trigger electrode can comprise a spark gap. In some embodiments of the present invention, the trigger electrode can comprise a plurality of carbon nanotubes or a diamond-like material, both of which are efficient electron emitters. The trigger electrode can be formed with a notched shape to localize the production of sparks or electrons used to trigger the device. The anode and the cathode can also each have a notched shape on a side thereof proximate to the trigger electrode.

A plurality of electrical vias can be provided in the vacuum switch, with the vias extending through the substrate to connect the anode, the cathode and the trigger electrode on one side of the substrate to electrical contacts on an opposite side of the substrate. This is useful so that the vacuum switch can be surface mounted (e.g. on an electrical circuit board, or on a CDU).

In certain embodiments of the present invention, the cover can comprise a metal. This can be advantageous since the metal cover can form at least a part of a the electrical conduction path between the anode and the cathode.

The present invention further relates to a vacuum switch which comprises an electrically-insulating substrate; an anode and a cathode spaced apart on a top side of the substrate; a trigger electrode disposed on the top side of the substrate between the anode and the cathode; a plurality of channels extending into the substrate on the top side thereof between the anode and the trigger electrode, and between the cathode and the trigger electrode, with the channels at least partially surrounding the anode and the cathode; and a cover sealed over the top side of the substrate to provide an evacuated region wherein the anode, the cathode and the trigger electrode are located. The electrical vacuum switch apparatus can further comprise a plurality of electrically-conducting vias formed through the substrate to electrically connect the anode, the cathode and the trigger electrode to contacts formed on a bottom side of the substrate.

The substrate can comprise an electrically-insulating material selected from the group consisting of glass, silica, quartz, diamond, alumina and ceramic. In some embodiments of the present invention, the substrate can comprise silicon, with an electrically-insulating layer being provided over an upper surface of the silicon substrate beneath the anode and cathode. The anode and the cathode can comprise a metal or metal alloy (e.g. comprising niobium, molybdenum, copper, tungsten, aluminum, etc.).

For certain embodiments of the present invention, the trigger electrode can comprise carbon which can be in the form of graphitic carbon, a diamond-like material, or a plurality of carbon nanotubes. In yet other embodiments of the present invention, the trigger electrode can comprise a spark gap.

The trigger electrode can comprise a plurality of notches on two sides thereof. The anode and the cathode can each comprise a plurality of notches on a side thereof facing the trigger electrode.

As described previously, in certain embodiments of the present invention, the cover can comprise a metal, and can be used to form a part of the conduction path between the anode and the cathode.

The present invention also relates to an electrical vacuum switch apparatus which comprises a substrate; an anode and a cathode spaced apart on a surface of the substrate; and a metal cover sealed over the substrate to provide an evacuated region wherein the anode and the cathode are contained in a vacuum environment, with the metal cover forming a trigger electrode to initiate an electrical discharge between the anode and the cathode. The metal cover can also form part of a conduction path for the discharge between the anode and the cathode. A plurality of carbon nanotubes, or alternately a diamond-like material, can be provided between the anode and the cathode to provide an electron emission to assist in initiating the electrical discharge between the anode and the cathode.

The substrate can comprise an electrically-insulating material such as glass, silica, quartz, diamond, alumina or a ceramic. Alternately, the substrate can comprise silicon, with an electrically-insulating layer provided over an upper surface of the silicon substrate beneath the anode and the cathode. One or more channels can be optionally provided extending below the surface of the substrate between the anode and the cathode to mitigate against surface breakdown in the device.

The anode and cathode can comprise a metal such as niobium, molybdenum, copper, tungsten, aluminum or an alloy thereof. The metal cover can also comprise niobium, molybdenum, copper, tungsten, aluminum or an alloy thereof.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings:

FIG. 10A shows the device prior to triggering thereof with trigger switch $S_1$ open. FIG. 10B shows formation of a current discharge path (indicated by the curved line with arrows) which occurs upon closing trigger switch $S_1$, with the current discharge path extending from the anode through the cover, which acts as the trigger electrode, to the cathode.

FIG. 12A shows the device prior to triggering thereof with trigger switch $S_1$ connected to ground. FIG. 12B shows the trigger switch $S_1$ connected to supply a trigger voltage $V_T$ which initiates a vacuum arc in the device by increasing an electric field between the anode and cathode and also by providing a field emission of electrons from a plurality of carbon nanotubes located between the anode and cathode.

DETAILED DESCRIPTION OF THE INVENTION

Figure 1:
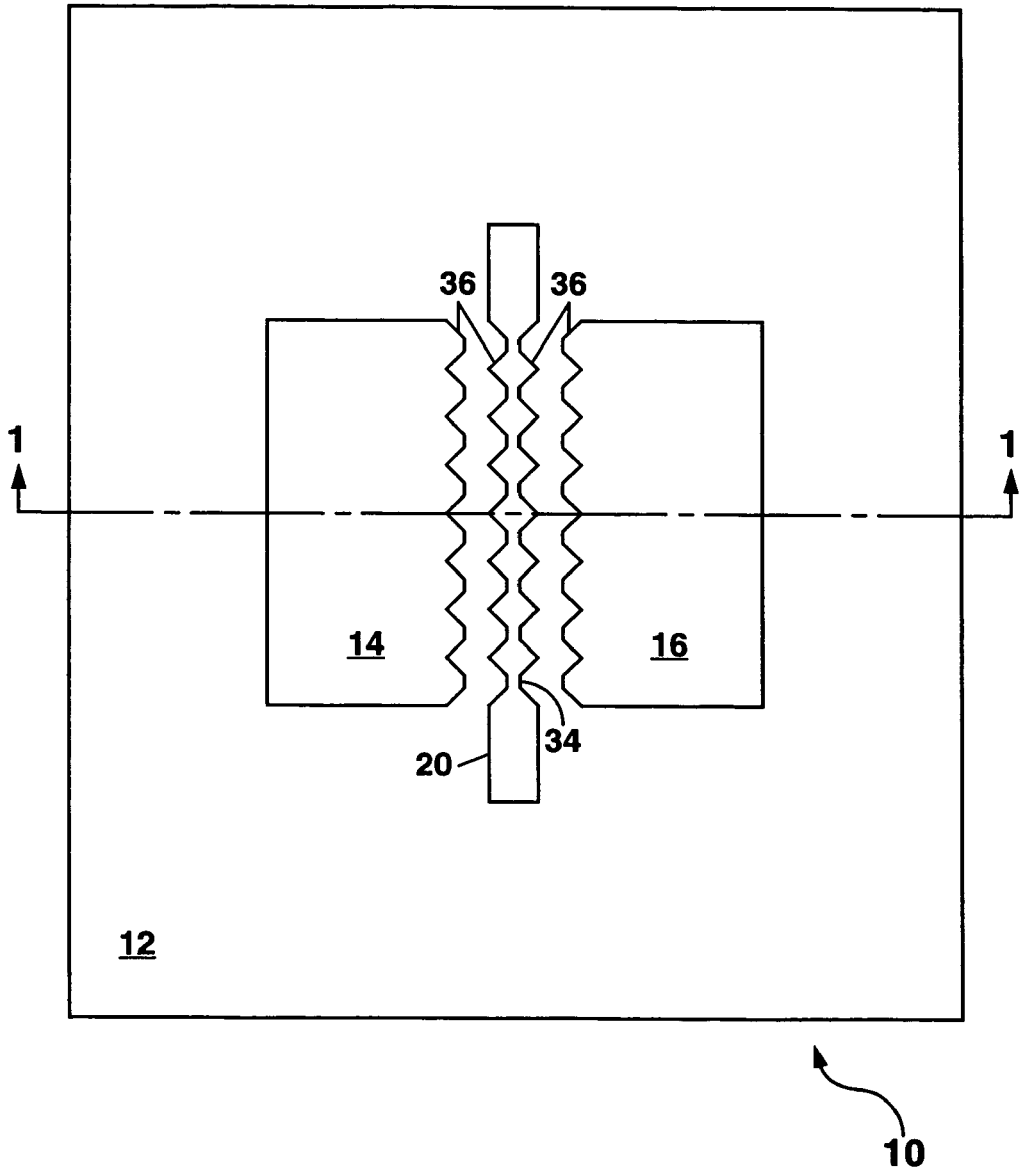
FIG. 1 shows a schematic plan view a first example of the vacuum switch of the present invention.
Figure 2:
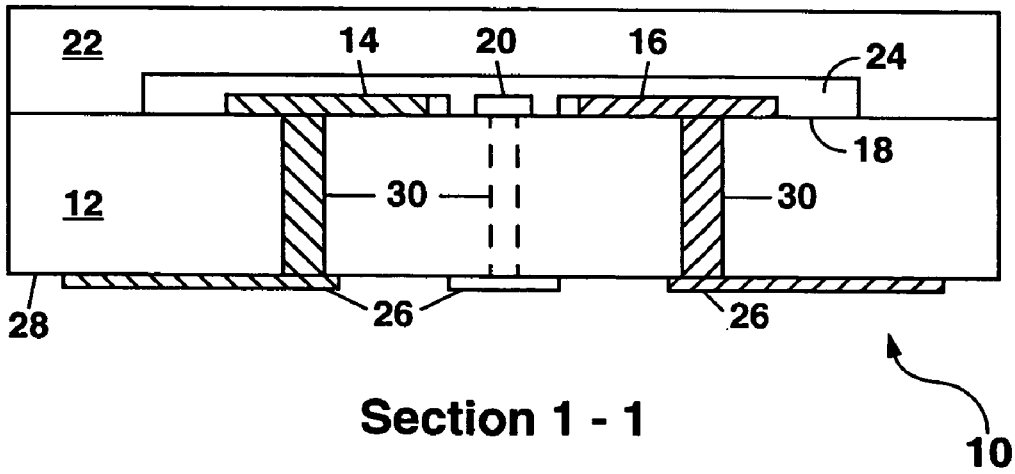
FIG. 2 shows a schematic cross-section view of the device of FIG. 1 along the section line 1-1 in FIG. 1.

Referring to FIG. 1, there is shown schematically in plan view a first example of the electrical vacuum switch apparatus 10 of the present invention. The apparatus 10 comprises a substrate 12, with an anode 14 and a cathode 16 being spaced apart on an upper surface 18 of the substrate 12, and with a trigger electrode 20 being located between the anode 14 and the cathode 16 on the same surface 18. A cover 22 is permanently sealed over the upper surface 18 of the substrate 12 to provide an evacuated region 24 wherein the anode 14, cathode 16 and trigger electrode 20 are all exposed to a vacuum environment. This is shown in FIG. 2 which represents a schematic cross-section view of the device 10 of FIG. 1. In FIG. 1, and in the schematic plan views of each other example of the present invention described herein, it is assumed that the cover 22 is transparent so that the structure beneath the cover 22 can be seen.

Electrical connections can be provided from the anode 14, cathode 16 and trigger electrode 20 to electrical contacts 26 located on a lower surface 28 of the substrate 12 to form a surface-mount package for the device 10. This is done by providing a plurality of electrically-conducting vias 30 through the substrate 12 which is generally electrically insulating. One or more vias 30 can be provided to each of the anode 14, cathode 16, and trigger electrode 20. The vias 30 can be, for example, 100-250 μm in diameter.

Those skilled in the art will understand that there are other ways of making the electrical contacts 26 to the anode 14, cathode 16 and trigger electrode 20 located in the evacuated region 24. As an example, one or more of the electrical contacts 26 can extend out from at least one edge of the substrate 12 (e.g. when the substrate 12 comprises a ceramic).

The substrate 12 can comprise an electrically-insulating material such as glass, silica, quartz, diamond, alumina or ceramic. Additionally, the substrate 12 can comprise silicon (i.e. a portion of a monocrystalline silicon wafer which is commonly used for forming integrated circuits) with an electrically-insulating oxide layer (i.e. $SiO_2$) being formed over all exposed surfaces of the substrate 12 and over sidewalls of openings formed through the silicon substrate 12 where the vias 30 are formed. Such a silicon substrate 12 covered with an electrically-insulating layer can be referred to as an "electrically-insulating substrate" since the silicon material forming the substrate 12 is electrically insulated from other elements formed thereon or therein including the anode 14, the cathode 16, the trigger electrode 20, the vias 30 and the contacts 26. The oxide layer, which can be on the order of a micron or more thick, can be formed by a thermal oxidation process or a high-pressure oxidation process whereby a portion of the silicon substrate is oxidized at a high temperature or high pressure or both, and thereby converted to silicon dioxide ($SiO_2$).

Other types of electrically-insulating layers can be formed over the substrate 12 in place of the oxide layer. As an example, silicon nitride or silicon oxynitride can be deposited over the surface 12 to form an electrically-insulating layer thereon using chemical vapor deposition. The silicon nitride or silicon oxynitride electrically-insulating layers can be about the same thickness as the oxide layer.

A plurality of devices 10, each having lateral dimensions of 5-7 millimeters (mm) and a thickness of 1-2 mm, for example, can be batch fabricated on a much larger common substrate 12 (e.g. with lateral dimensions of 2-8 inches) and then separated once fabrication is completed. In this way, up to hundreds of individual devices 10 can be batch fabricated at the same time with substantially identical operating characteristics.

In the example of FIGS. 1 and 2, the cover 22 can be formed from an electrically-insulating material as described above, from silicon (with or without an oxide layer formed thereon), or from a metal such as molybdenum, niobium, copper, tungsten, aluminum or an alloy thereof. The use of a metal cover 22 can be advantageous since the presence of the metal can serve to draw a high-current arc between the anode 14 and the cathode 16 upward into the metal cover 22 and away from the substrate 12 after initial formation of the arc in the evacuated region 24 between the anode 14 and cathode 16.

The metal cover 22 provides a high-current-carrying capacity and can form at least a part of the current discharge path (also termed herein an electrical conduction path) between the anode 14 and the cathode 16. Additionally, any material which has been evaporated or sputtered from the anode 14, cathode 16 or trigger electrode 20 by the high-current arc will be drawn to where the arc enters or exits the metal cover 22 and deposited there. This prevents deposition of the evaporated or sputtered material on the upper surface 18 of the substrate 12 where the material could possibly lead to surface breakdown upon repeated operation of the vacuum switch 10.

The cover 22 can be etched to form a recess therein which defines the shape of the evacuated region 24. When the cover 22 comprises metal, the metal cover 22 can be shaped by etching, stamping, molding, plating over a mandrel, etc. For batch fabrication of the vacuum switch 10, a plurality of covers 22 can be formed as a single cover plate which can be sealed over a common substrate containing a plurality of anodes 14, cathodes 16, trigger electrodes 20, etc., to form a plurality of devices 10 which can then be separated by sawing or laser cutting once fabrication is completed.

The cover 22 can be sealed to the substrate 12 under a high vacuum using a conventional wafer bonding method as known to the art. This can be done by eutectic bonding (e.g. Au/Si eutectic bonding when the substrate 12 and cover 22 comprise silicon with a layer of gold deposited on one or both of the substrate 12 and cover 22), or by diffusion bonding (also termed anodic bonding).

Alternately, the cover 22 can be sealed to the substrate 12 under high vacuum by brazing using a filler metal 32 (see FIG. 4) which can comprise gold. The filler material can be provided as a preform, or deposited over the substrate 12, or cover 22, or both by evaporation, sputtering or plating. As an example, layers of gold and nickel can be evaporated or plated to a layer thickness of up to a few microns to form the filler metal 32. The gold and nickel upon heating to a brazing temperature of about 1000° C. under vacuum will form an 82% gold/18% nickel alloy (also termed Nioro) which will permanently attach the cover to the substrate 12. Those skilled in the art will understand that other filler metals can be used to join the materials used for the substrate 12 and cover 22 for the vacuum switch 10 of the present invention, with the exact filler metals being selected depending upon thermal considerations of the various materials used for the vacuum switch 10.

In the example of FIGS. 1 and 2, the anode 14 and cathode 16 can comprise metals such as molybdenum, niobium, copper, tungsten, aluminum, or an alloy of one or more of these metals. The above metals and metal alloys can also be made gas-free to prevent an accumulation of gases within the evacuated region 24 that might otherwise emanate from the anode 14 and cathode 16 during operation of the device 10. Additionally, these metals, and especially niobium, molybdenum and tungsten, have relatively high melting points which minimizes evaporation of the metals during discharge to prevent the upper surface 18 within the evacuated region 24 from being coated with the metals and eventually short-circuiting the device 10, or reducing the number of times the device 10 can be switched.

The metals used for the anode 14 and cathode 16 can be deposited over the substrate 12 to a layer thickness of up to a few microns or more by evaporation, sputtering or plating. If needed, a thin layer of titanium can be provided beneath the metals used for the anode 14 and cathode 16 to promote a better adhesion of these metals to the substrate 12.

The trigger electrode 20 in the example of FIGS. 1 and 2 can comprise carbon deposited to a layer thickness of up to a few microns. If needed, a thin titanium layer can be deposited and patterned on the substrate 12 to improve adhesion of the carbon used to form the trigger electrode 20.

The carbon used for the trigger electrode 20 can be in several different forms with different electron emission characteristics. The carbon can comprise graphitic carbon which can be deposited, for example, by chemical vapor deposition or sputtering, and which emits electrons due to plasma emission, thermionic emission, thermo-field emission, or a combination of these types of emission.

Alternately, the carbon used for the trigger electrode 20 can comprise a diamond-like material (e.g. diamond, diamond-like carbon, or amorphous diamond) which can be deposited by chemical vapor deposition or pulsed laser deposition. The diamond-like material can have a negative electron affinity which allows electrons to be readily emitted under the influence of a voltage applied across the trigger electrode 20. An electron accelerated by this applied trigger voltage will tend to skip across the surface of the diamond-like material knocking out further electrons through secondary emission, resulting in an avalanche of electrons on the surface of the diamond-like material to initiate the vacuum arc between the anode 14 and cathode 16. The diamond-like material can be doped (e.g. with boron) to further reduce the work function at the surface of this material and thereby enhance electron emission. The diamond-like material also provides a high stability with little, if any, of the diamond-like material being expected to be dislodged or eroded from the trigger electrode 20 during repeated operation of the vacuum switch 10. Furthermore, the diamond-like material provides a high thermal conductivity so that any surface heating of the trigger electrode 20 can be conducted away into the substrate 12, thereby improving the lifetime of the vacuum switch 10 for repeated operation. Further details of diamond-like materials can be found in M. R Siegal et al., *Diamond and Diamond-Like Carbon Films for Advanced Electronic Applications* (Sandia National Laboratories Report No. SAND96-0516, March 1996, available from National Technical Information Service, U.S. Department of Commerce), which is incorporated herein by reference.

In FIG. 1, the trigger electrode 20 has a notched shape comprising a plurality of necked-down regions 34 spaced about the length of the electrode 20, with the necked-down regions 34 being separated by outward-extending teeth 36 on each side of the electrode 20 to form a notched shape for the trigger electrode 20. The carbon used for the trigger electrode 20 can be deposited along the entire length of the trigger electrode 20, or alternately only in the necked-down regions 34, with the remainder of the trigger electrode 20 comprising a metal or metal alloy (e.g. comprising niobium, molybdenum, copper, tungsten, aluminum etc.). The anode 14 and cathode 16 can also each have a notched shape on a side thereof facing the trigger electrode 20. Teeth 36 on the anode 14 and cathode 16 can be aligned with the necked-down regions 34 to provide a localized higher electric field at these locations so that a plurality of vacuum arcs will be initiated at these locations upon triggering of the vacuum switch 10.

A high-voltage of up to several kiloVolts from an external power source (e.g. a CDU) can be applied between the anode 14 and cathode 16 for switching by the device 10. The separation of the anode 14 and cathode 16, which can be on the order of a few hundred microns or more, is sufficient to stand off the applied high voltage and prevent conduction between the anode 14 and cathode 16 in the absence of a trigger signal applied along the length of the trigger electrode 20 via the pair of contacts 26. However, once the trigger signal, which can be on the order of 100-200 volts or less, is applied, one or more sparks comprising electrons and ions are generated by the trigger electrode; and this initiates a vacuum arc between the anode 14 and cathode 16. The current in the vacuum arc can be up to a kiloAmpere or more.

When the trigger signal is applied suddenly, an electrical current pulse is conducted along the length of the trigger electrode 20. In the necked-down regions 34, a cross-sectional area of the carbon forming the trigger electrode 20 is significantly reduced. This leads to a relatively large localized increase in current density at these regions 34 which produces localized heating accompanied by the generation of a plurality of sparks. The exact mechanism for generation of the sparks is not well understood, although it may include plasma emission, thermionic emission, thermo-field emission, or a combination of these types of emission. The sparks then act to trigger the vacuum arc between the cathode 16 and anode 14 as described above. The notched shapes of the anode 14 and cathode 16 serve to concentrate an electric field between the anode 14 and cathode 16 at the locations of the necked-down regions 34 where the sparks are generated so that a plurality of arcs are formed which are stable, and which are expected to be uniformly distributed across the width of the anode 14 and cathode 16.

The term "notched shape" as used herein refers to a shape which comprises a plurality of V-shaped, U-shaped or arbitrary-shaped indentations which are arranged side-by-side along at least one side of an element of the apparatus 10.

Returning to FIGS. 1 and 2, openings through the substrate 12 where the vias 30 are to be formed can be etched or drilled (e.g. mechanically, or with a laser). Metal (e.g. tungsten, or copper, or both) can be deposited or plated to fill in the openings and form the vias 30 which can have a diameter of, for example, 100-250 μm. Alternately, a metal, metal alloy or combination of metals can be deposited into the via openings by screen printing followed by sintering.

The contacts 26 can be formed from a metal or metal alloy which is solderable (e.g. copper, nickel, tin or a combination thereof). The contacts 26 can be formed by metal evaporation or plating, or alternately by screen printing and sintering.

Figure 3:
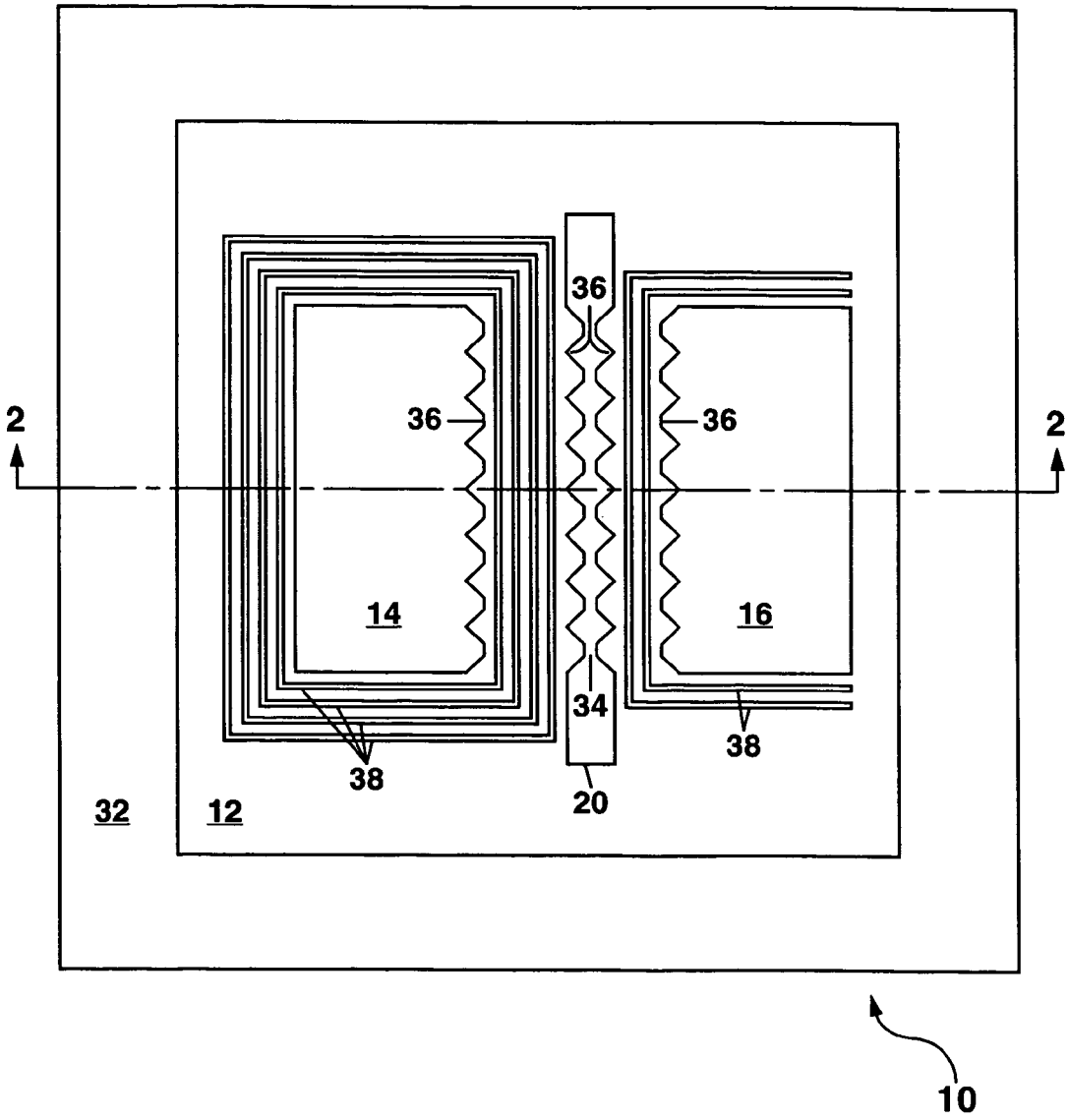
FIG. 3 shows a schematic plan view of a second example of the vacuum switch of the present invention.
Figure 4:
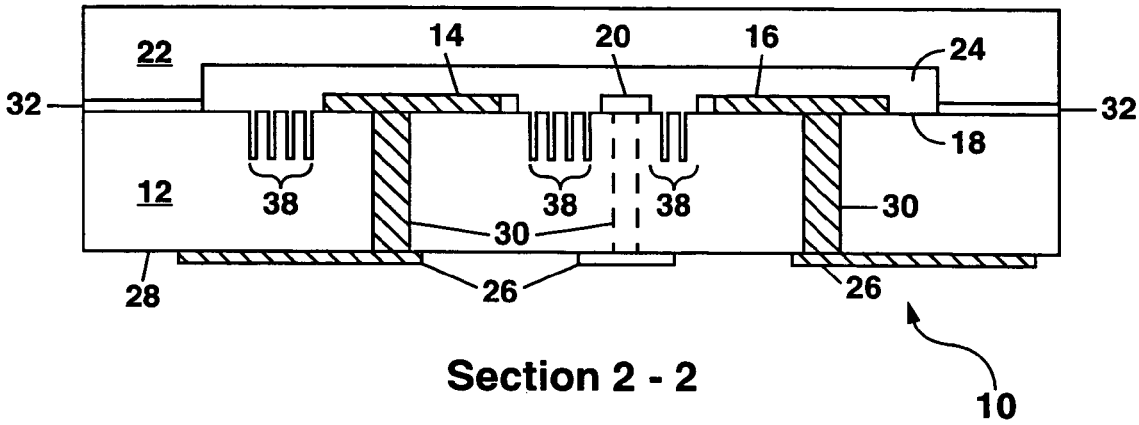
FIG. 4 shows a schematic cross-section view of the device of FIG. 3 along the section line 2-2 in FIG. 3.

FIGS. 3 and 4 show schematic plan and cross-section views, respectively, of a second example of the vacuum switch 10 of the present invention. In this second example, one or more channels 38 can be formed in the substrate 12. This can be done by etching through a photolithographically-defined etch mask provided over the substrate 12 with openings in the etch mask to expose portions of the substrate 12 where the channels 38 are to be etched. The etching can be performed using well-known wet etchants, or alternately by plasma etching (e.g. reactive ion etching).

Each channel 38 can extend partway or entirely around the anode 14, the cathode 16, or both. Each channel 38 is also generally formed with a high aspect ratio so that the depth of the channel 38 is larger than the width thereof. As an example, each channel 38 can be 10-20 μm wide and 50-100 μm deep. The sidewalls of each channel can be substantially straight as shown in FIG. 4, or tapered. When the substrate 12 comprises silicon, the channels 38 can be formed prior to oxidation of the substrate so that the oxide layer completely blankets the interior of each channel 38.

The purpose of the channels 38 in the example of FIGS. 3 and 4 is to provide an increased surface path length between the anode 14 and the cathode 16 so that any electrical breakdown between the anode 14 and cathode 16 does not occur on the upper surface 18 (i.e. surface breakdown), but instead occurs above the surface 18 in the evacuated region 24 (i.e. vacuum breakdown). Generally, surface breakdown occurs over a given electrode spacing at a lower voltage than the voltage required for vacuum breakdown over the same spacing. The voltage at which surface breakdown occurs can also be significantly lowered due to contaminants on the upper surface 18 of the substrate 12 (e.g. due to metal or carbon electrode material evaporated or sputtered from the anode 14, cathode 16 and trigger electrode 20). The provision of one or more high-aspect-ratio channels 38 in the device 10 of FIGS. 3 and 4 has an additional advantage that a portion of the interior surface of each channel 38 will be shadowed from any emitted electrode material. Thus, the channels 38 will act to interrupt any current discharge path through the emitted electrode material to help to prevent surface breakdown in the device 10 from this emitted electrode material even after multiple operations of the vacuum switch 10.

The provision of channels 38 in the device 10 of FIGS. 3 and 4 is more critical at the anode 14 since evaporation or sputtering of the electrode material is generally greater at the anode 14 than at the cathode 16. As a result, a larger number of channels 38 can be provided about the anode 14 according to the present invention. A separation between the anode 14 and the trigger electrode 20 can be made larger than the separation between the cathode 16 and the trigger electrode 20 to accommodate the larger number of channels 38, and since the voltage between the trigger electrode 20 and cathode 16 is generally much smaller than the voltage between the trigger electrode 20 and the anode 14. Additionally, since the anode 14 is generally maintained at a higher electrical potential than the cathode 16 prior to switching of the device 10, the channels 38 can extend completely around the anode 14 to prevent the possibility of surface breakdown between the anode 14 and the filler metal 32, or the cover 22.

Figure 5:
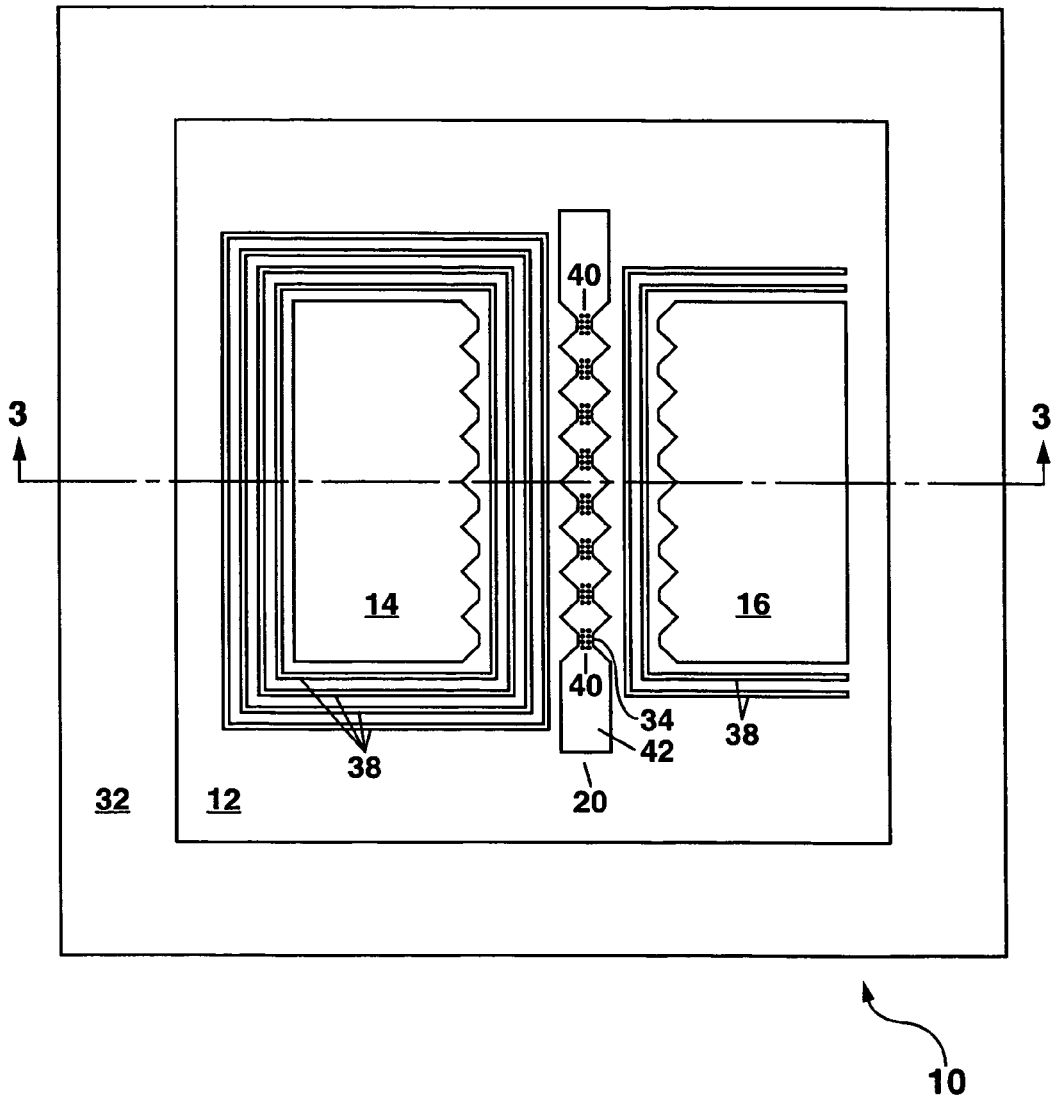
FIG. 5 shows a schematic plan view of a third example of the vacuum switch of the present invention.
Figure 6:
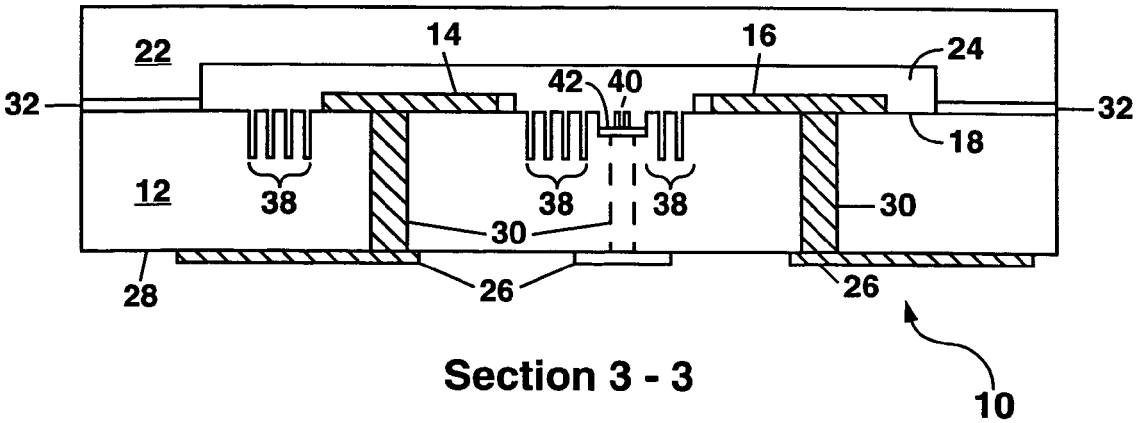
FIG. 6 shows a schematic cross-section view of the device of FIG. 5 along the section line 3-3 in FIG. 5.

A third example of the electrical vacuum switch apparatus 10 of the present invention is schematically illustrated in plan view in FIG. 5, and in cross-section view in FIG. 6. The third example of the present invention is similar to the second example of FIGS. 3 and 4 except that the trigger electrode 20 comprises a plurality of carbon nanotubes 40. The carbon nanotubes 40, which are essentially single- or multi-walled tubes having a wall thickness on an atomic scale, can have a relatively low effective work function due to field enhancement at their tips, thereby making them efficient electron emitters. Electron emission in the carbon nanotubes 40 can be produced thermionically (i.e. thermionic emission) by resistive heating produced by the trigger signal conducted across the trigger electrode 20. This thermionic emission can then act to trigger a vacuum arc between the anode 14 and cathode 16, thereby switching the device 10 from a nonconducting state to a conducting state. Field emission in the trigger electrode 20 can also be produced in the carbon nanotubes 40 to initiate the vacuum arc.

Figure 7:
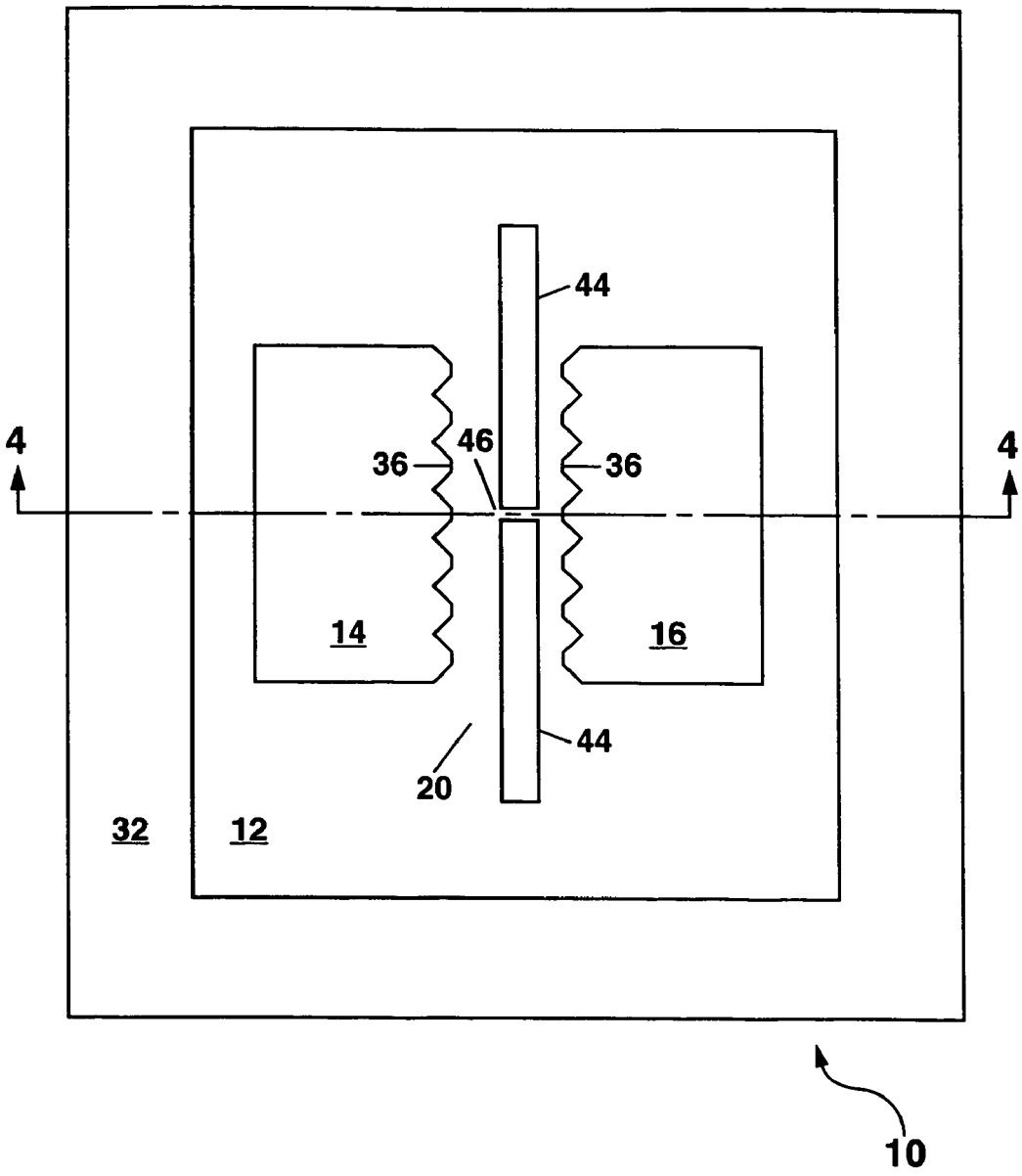
FIG. 7 shows a schematic plan view of a fourth example of the vacuum switch of the present invention.

The carbon nanotubes 40 can be vertically oriented as shown in FIG. 6, or horizontally oriented, or even randomly oriented. The carbon nanotubes 40, which can be single-walled or multi-walled, are located proximate to the necked-down regions 34 of the trigger electrode 20. Although FIGS. 6 and 7 show only a small number of carbon nanotubes 40 located in the necked-down regions 34 for clarity, the actual number of carbon nanotubes 40 in each necked-down region 40 can be up to thousands or more of carbon nanotubes 40 since each single-wall carbon nanotube 40 has a typical diameter on the order of 1-2 nanometers (nm), with multi-wall carbon nanotubes 40 having diameters of up to 50-100 nm.

There are many ways of fabricating the carbon nanotubes 40 in the necked-down regions 34 of the trigger electrode 20 as will be described hereinafter. In the example of FIGS. 5 and 6, the carbon nanotubes 40 are located in a shaped trench having the notched shape of the trigger electrode 20. This can help to prevent erosion of the carbon nanotubes 40 by the vacuum arc by locating the carbon nanotubes 40 below the upper surface 18 of the substrate 12. In other embodiments of the present invention, the carbon nanotubes 40 can extend above the upper surface 18, or be entirely located above the upper surface 18 of the substrate 12.

In preparation for forming the carbon nanotubes 40 in the example of FIGS. 5 and 6, the shaped trench having the notched shape of the trigger electrode 20 can be etched into the substrate 12. This can be done at the same time the channels 38 are formed. When the substrate 12 comprises silicon, this is preferably done prior to oxidation of the substrate 12 so that the oxide layer formed by oxidizing the substrate 12 also covers the sidewalls and bottom of the shaped trench. The shaped trench can be, for example, 20-100 μm deep.

An electrically-conductive layer 42 can be provided in the shaped trench to make electrical contact with the vias 30 and to conduct the trigger signal between the necked-down regions 34. The electrically-conductive layer 42 can comprise a metal or metal alloy (e.g. comprising molybdenum, niobium, copper, tungsten, titanium, aluminum, etc.,) or alternately carbon (e.g. graphitic carbon or a diamond-like material), and can have a layer thickness of up to about one micron. If needed, a thin (about 10-20 nm thick) layer of titanium can be used to promote adhesion of the electrically-conductive layer 42 to the substrate 12.

The carbon nanotubes 40 can be grown directly in the necked-down regions 34. This can be done by depositing a transition metal catalyst (e.g. iron or nickel deposited by evaporation or sputtering) in the necked-down regions 34. The transition metal catalyzes growth of the carbon nanotubes 40 during deposition by chemical vapor deposition (CVD) at an elevated temperature (e.g. 650-700° C.) using a hydrocarbon feed gas (e.g. acetylene or methane). Additional hydrogen can be added to the feed gas to prevent deposition of carbon on the substrate 12 during formation of the carbon nanotubes.

The fabrication of carbon nanotubes by CVD is well known to the art. See e.g. Y. Tzeng et al., "Fabrication and Characterization of Non-Planar High-Current-Density Carbon-Nanotube Coated Cold Cathodes," *Diamond and Related Materials*, vol. 12, pp. 442-445 (2003); and Y. Y. Wei et al., "Direct Fabrication of Carbon Nanotube Circuits by Selective Area Chemical Vapor Deposition on Pre-Patterned Structures," *Nanotechnology*, vol. 11, pp. 61-64 (2000), both of which are incorporated herein by reference.

In some embodiments of the present invention, the carbon nanotubes 40 can be grown directly onto a silicon dioxide layer (e.g. the oxide layer formed in the shaped trench when a silicon substrate 12 is used) using CVD without a transition metal catalyst. In these embodiments of the present invention, the electrically-conductive layer 42 can be used to conduct the trigger signal between the necked-down regions 34, with the conduction of the trigger signal through the necked-down regions 34 being provided by the carbon nanotubes 40 which can be closely packed together. A plurality of horizontally-oriented carbon nanotubes can also be grown in place between portions of the electrically-conductive layer 42 to bridge across each necked down region 34.

In other embodiments of the present invention, the carbon nanotubes 40 can be provided along a majority of the length of the trigger electrode 20. This can be done, for example, by dispersing the carbon nanotubes into a plating solution and co-precipitated them out with a metal plating (e.g. comprising copper) which can be used to form the electrically-conductive layer 42. By providing an electric field having field lines oriented substantially perpendicular to the upper surface 18 of the substrate 12 during the plating process, the carbon nanotubes 40 can be oriented vertically. In the absence of an electric field, the carbon nanotubes 40 will generally be randomly oriented. Further details of forming the carbon nanotubes 40 by co-precipitation during metal plating can be found, for example, in U.S. Pat. Nos. 6,796,870 and 6,891,320 to Nakamoto, which are incorporated herein by reference.

Yet another way of forming the carbon nanotubes 40, is to mix a plurality of pre-formed and commercially available carbon nanotubes 40 into a metal paste (e.g. comprising tungsten, copper, molybdenum, niobium, tungsten, aluminum or combinations thereof) which can be deposited in the necked-down regions 34, or alternately along the entire length of the trigger electrode 20. This can be done by screen printing or ink-jet deposition. The metal paste containing the carbon nanotubes 40 can then be sintered. This generally results in randomly oriented carbon nanotubes 40.

Figure 8:
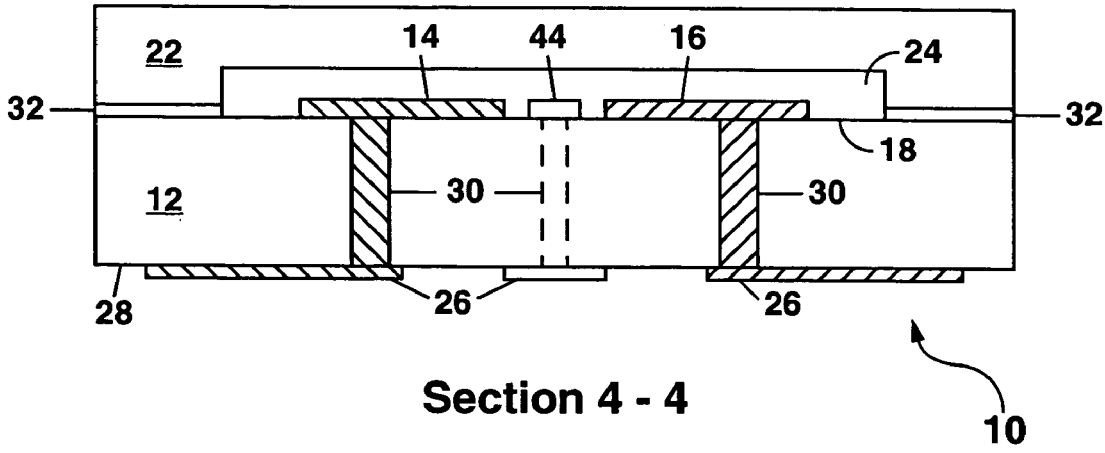
FIG. 8 shows a schematic cross-section view of the device of FIG. 7 along the section line 4-4 in FIG. 7.

FIGS. 7 and 8 show schematic plan and cross-section views, respectively, of a fourth example of the vacuum switch 10 of the present invention. In the example of FIGS. 7 and 8, the trigger electrode 20 comprises a pair of electrically-conductive strip electrodes 44 separated by a narrow spark gap 46. The strip electrodes 44 can comprise the same metals used to form the anode 14 and cathode 16 (e.g. molybdenum, niobium, copper, tungsten, aluminum and alloys thereof). The exact width of the spark gap 46 between the strip electrodes 44 will depend upon a predetermined voltage for the trigger signal which is used to generate a spark across the gap 46 and thereby trigger electrical breakdown (i.e. the vacuum arc) between the anode 14 and cathode 16 during operation of the device 10. The width of the spark gap 46 will generally be on the order of one-tenth of the separation between the anode 14 and cathode 16 or less, and can be, for example, 2-40 μm.

An optional channel (not shown) can be etched into the substrate 12 beneath the spark gap 46 to prevent surface breakdown between the strip electrodes 44 during application of the trigger signal. This channel can be, for example, 50-100 μm deep and at least as long and wide as the spark gap 46. Additionally, this channel can extend for a distance of a few microns or more beneath the ends of the strip electrodes 44 proximate to the spark gap 46 when the channel is formed using an isotropic etchant. By forming a channel beneath the spark gap 46 as described above, the trigger signal will produce a spark in the evacuated region 24 between the strip electrodes 44 (i.e. vacuum breakdown) rather than possibly occurring due to surface breakdown on the upper surface 18 of the substrate 12. When the substrate 12 comprises silicon, the channel beneath the spark gap 46 can be formed prior to oxidation of the substrate 12 so that the sidewalls and bottom of the channel will be covered by the oxide layer. If needed to provide additional protection against surface breakdown between the anode 14 and the cathode 16 in the example of FIGS. 7 and 8, an additional plurality of channels 38 can also be formed partially or entirely around the anode 14 and cathode 16 as described previously with reference to FIGS. 3 and 4.

Figure 9:
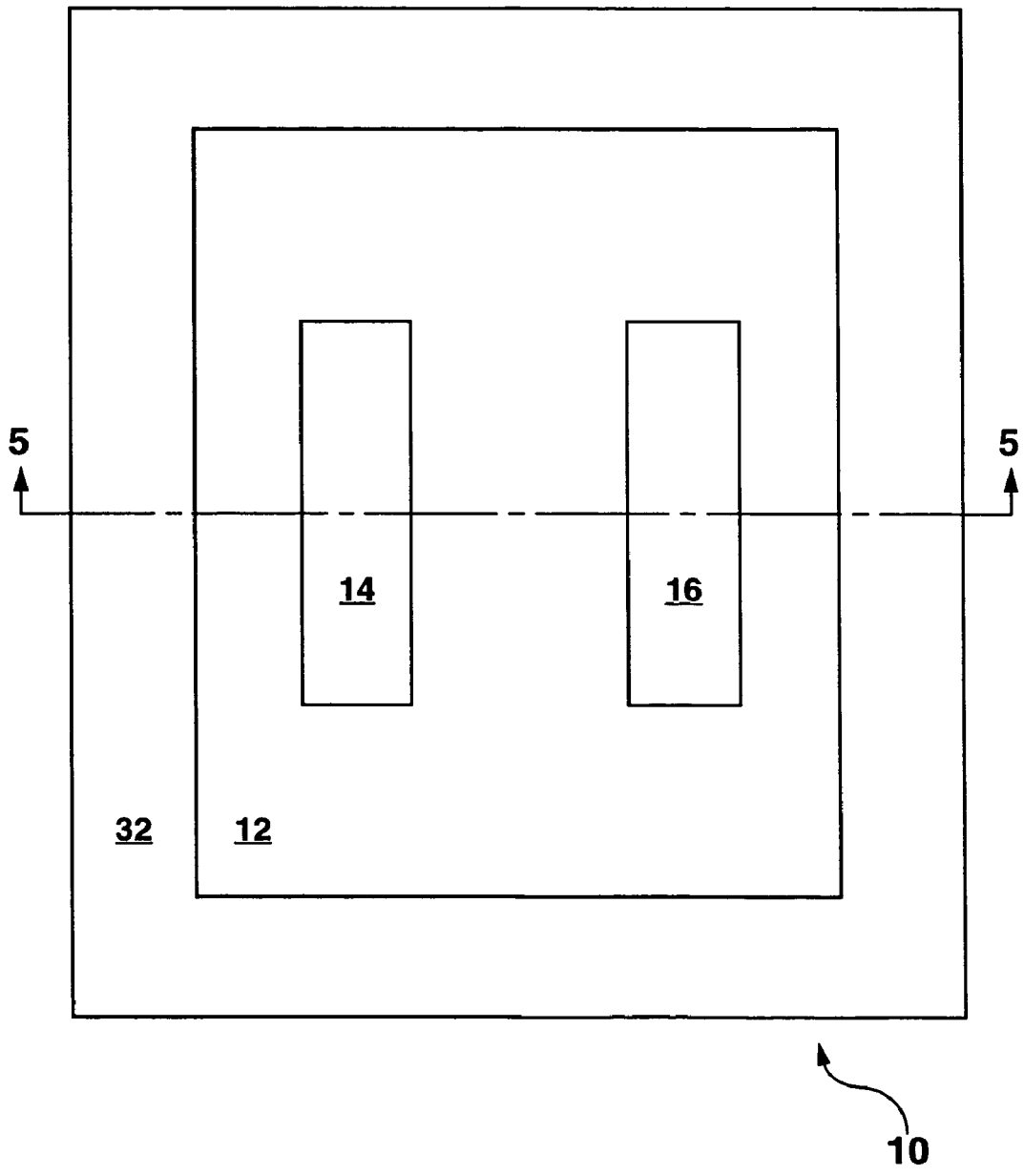
FIG. 9 shows a schematic plan view of a fifth example of the vacuum switch of the present invention.

FIG. 9 shows a schematic plan view of a fifth example of the vacuum switch 10 of the present invention. In this example of the vacuum switch 10, a metal cover 22 is used which also functions as a trigger electrode. The metal cover 22 can be electrically connected to a contact 26 on the lower surface 28 of the substrate 12 using a via 30 and the filler metal 32 which attaches the cover 22 to the substrate 12 (see FIG. 10A).

Figure 10A:
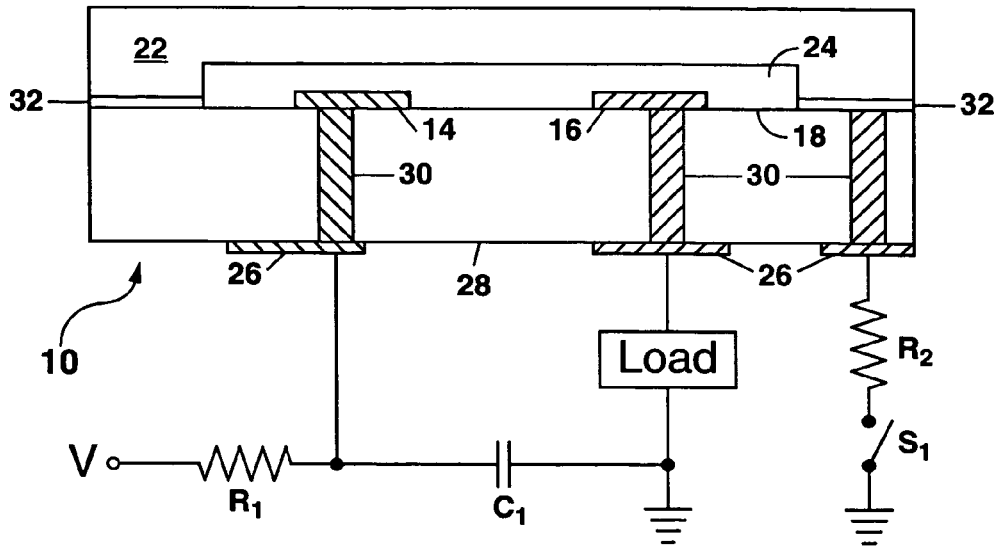
FIGS. 10A and 10B show schematic cross-section views of the device of FIG. 9 along the section line 5-5 in FIG. 9 together with an example of a capacitive discharge circuit with which the vacuum switch can be used.
Figure 10B:
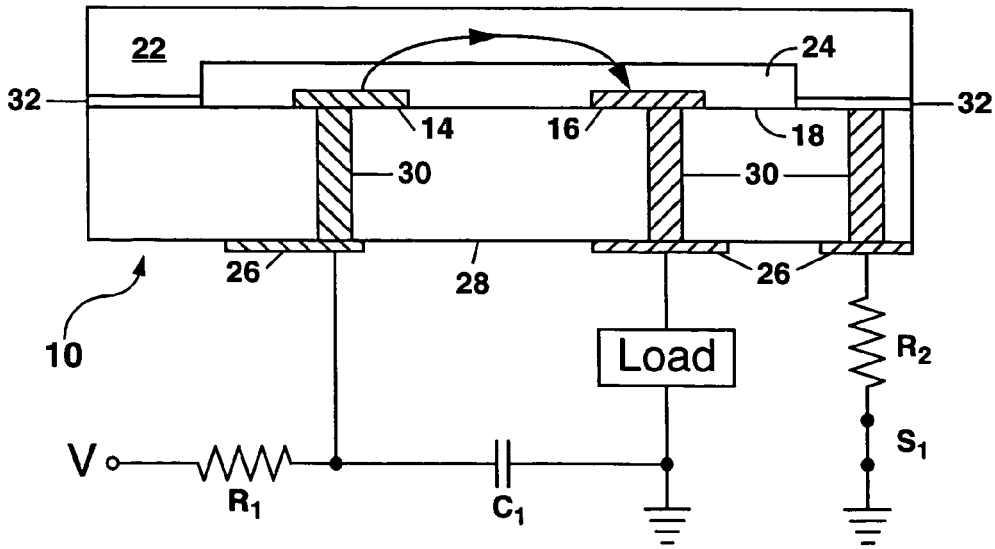

FIGS. 10A and 10B show schematic cross-section views of the vacuum switch 10 of FIG. 9 along the section line 5-5 in FIG. 9 to illustrate operation of this example of the vacuum switch 10. In FIG. 10A, the device 10 is shown connected to a capacitive discharge circuit which comprises resistors $R_1$ and $R_2$, capacitor $C_1$, and switch $S_1$ (which can be a mechanical switch or alternately a thyristor or a transistor) to form a CDU. A voltage source, V, can be used to charge the capacitor $C_1$ to a high direct-current (dc) voltage of up to several thousand volts. With switch $S_1$ open as shown in FIG. 10A, the metal cover 22 is electrically floating. However, when $S_1$ is closed as shown in FIG. 10B, the metal cover 22 is pulled to ground through resistor $R_2$. In other embodiments of the present invention, the metal cover 22 can be connected through resistor $R_2$ to a negative bias source to negatively bias the cover 22 at a voltage of up to a few hundred volts when switch $S_1$ is closed. In either case, switching the metal cover 22 to ground or to a negative voltage can initiate a vacuum arc between the anode 14 and cover 22. The initiation of the vacuum arc very quickly raises the voltage on the metal cover 22 to about the same voltage on the anode 14 and produces a second vacuum arc between the cover 22 and the cathode 16, thereby discharging the majority of the electrical energy stored in the capacitor $C_1$ into the load (which can be an explosive initiator, flashlamp, etc.) with a peak current of up to one kiloAmpere or more, with a relatively small amount of energy being dissipated by resistor $R_2$.

In this example of the present invention, the anode 14 and cathode 16 can be of arbitrary shape since a current discharge path is not formed directly between the anode 14 and cathode 16 in the evacuated region 24, but instead flows from the anode 14 through the metal cover 22 and back to the cathode 16 as indicated by the curved lines with arrows in FIG. 10B. As previously mentioned, this can help to prevent any accumulation of contaminants on the upper surface 18 of the substrate 12 due to metal evaporated or sputtered from the anode 14 and cathode 16. One or more channels 38 can also be optionally formed in the substrate 12 as previously described to further prevent the possibility of surface breakdown during repeated operation of the vacuum switch 10.

Figure 11:
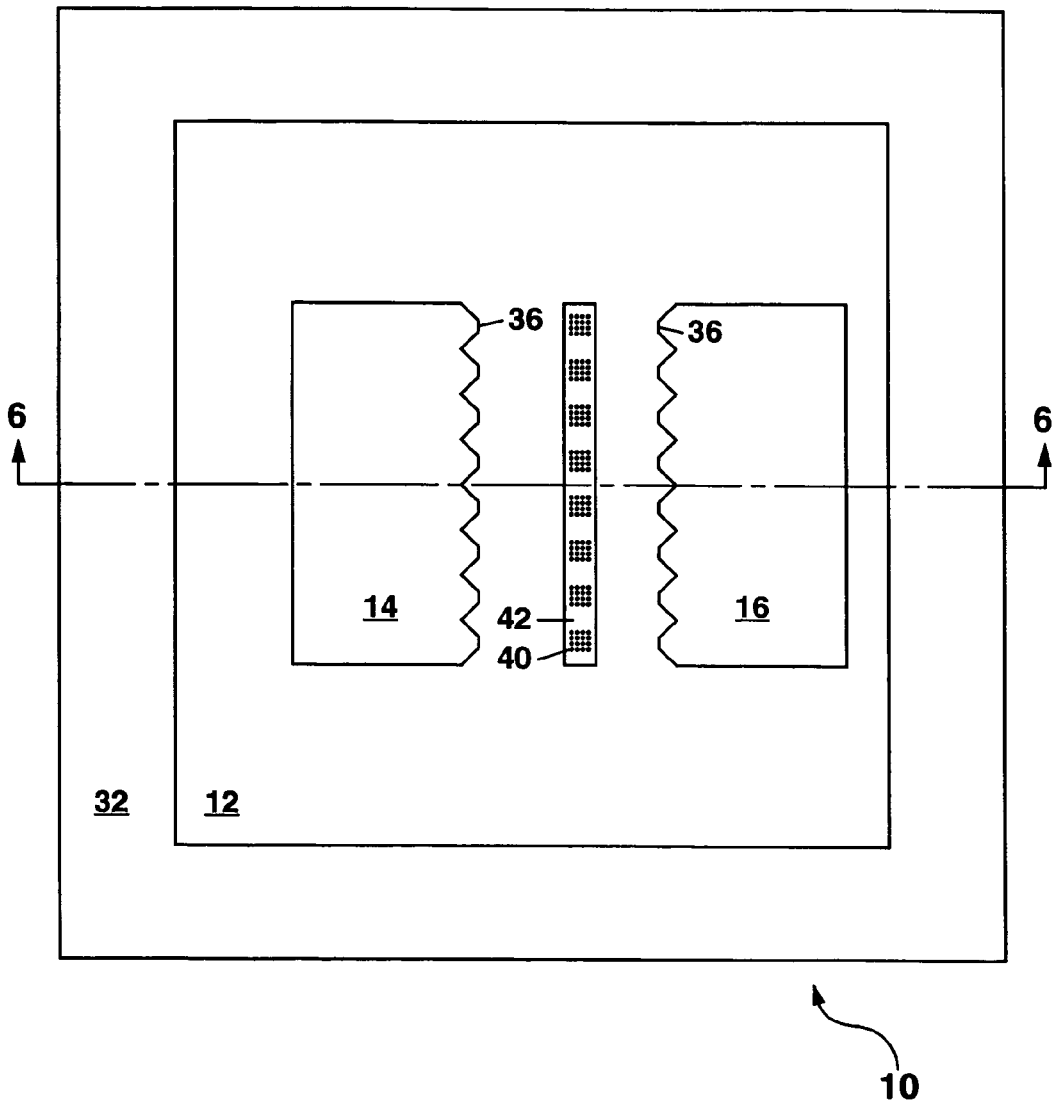
FIG. 11 shows a schematic plan view of a sixth example of the vacuum switch of the present invention.

FIG. 11 shows a schematic plan view of a sixth example of the vacuum switch of the present invention. This example of the vacuum switch 10 also uses a metal cover 22 which functions as a trigger electrode, with the metal cover 22 being electrically connected through the filler metal 32 and a via 30 to a contact 26 on the lower surface 28 of the substrate 12. In the device of FIG. 11, the metal cover 22 can be used to control and switch an electric field between the anode 14 and cathode 16 and thereby initiate the vacuum arc.

Figure 12A:
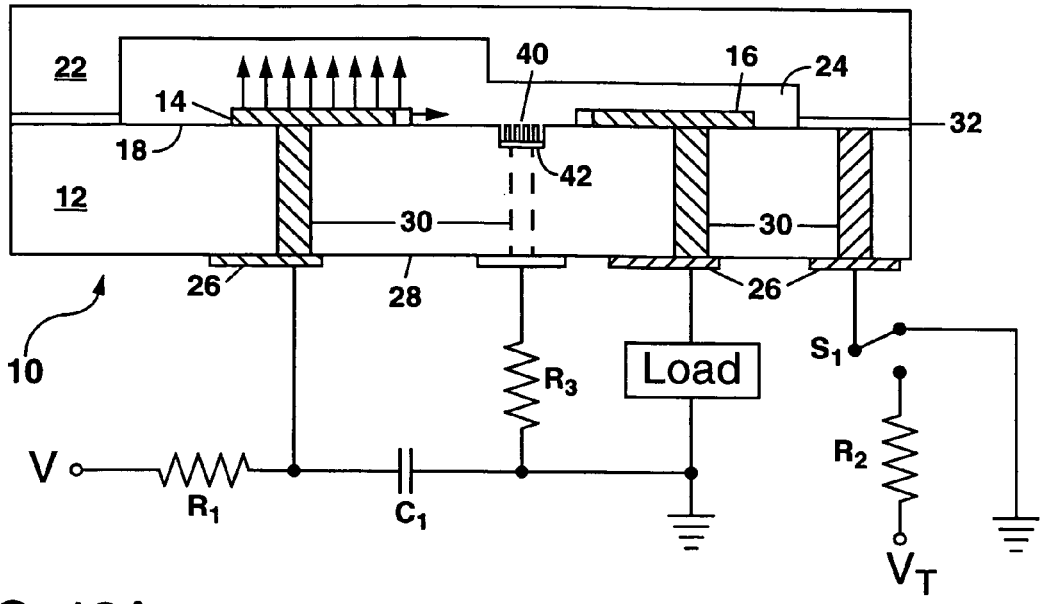
FIGS. 12A and 12B show schematic cross-section views of the device of FIG. 11 along the section line 6-6 in FIG. 11 together with an example of a capacitive discharge circuit with which the vacuum switch can be used.
Figure 12B:
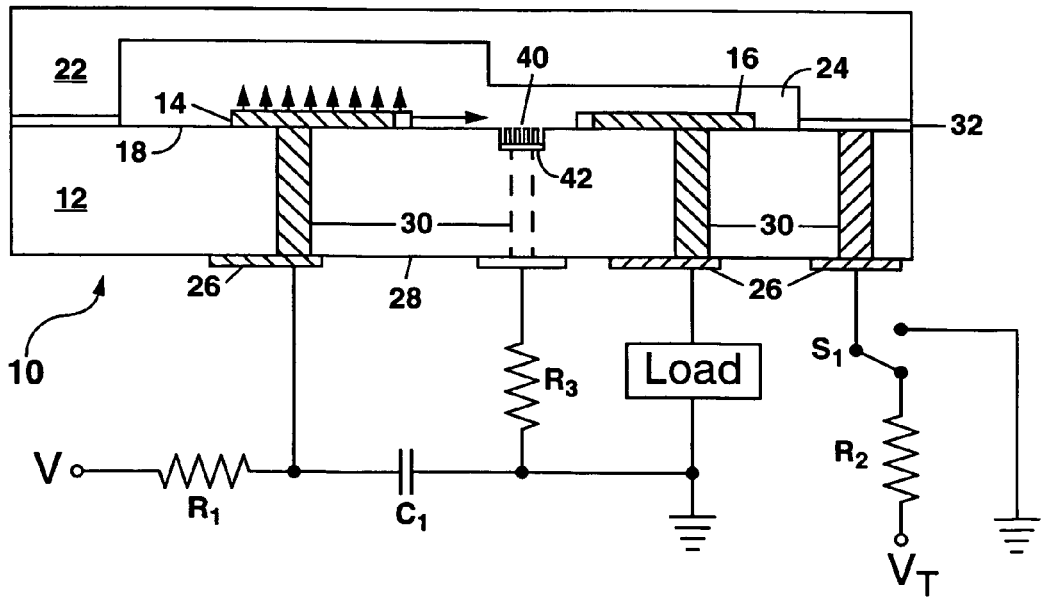

FIGS. 12A and 12B show schematic cross-section views of the vacuum switch 10 of FIG. 11 along the section line 6-6 in FIG. 11 to illustrate operation of this example of the vacuum switch 10. In FIG. 12A, the vacuum switch 10 is shown connected to a capacitive discharge circuit which comprises resistors $R_1$, $R_2$ and $R_3$, capacitor $C_1$, and switch $S_1$ (which can be a mechanical switch or alternately a thyristor or a transistor) to form a CDU. A voltage source, V, can be used to charge the capacitor $C_1$ to a high dc voltage of up to several thousand volts. With switch $S_1$ connected to ground as shown in FIG. 12A, an electric field produced by the high dc voltage of up to several thousand volts is concentrated between the anode 14 and the metal cover 22 (i.e. the grounded trigger electrode). A much smaller electric field is produced between the anode 14 and cathode 16 since the spacing between these elements is substantially larger than that between the anode 14 and cover 22. In FIG. 12A, the relatively large (i.e. concentrated) electric field between the anode 14 and metal cover 22 is indicated by the plurality of vertical arrows which have a relatively long length indicative of the magnitude of the electric field. The relatively small electric field between the anode 14 and cathode 16 is indicated by the horizontal arrow which is shorter to indicate the smaller magnitude of the electric field directed towards the cathode 16. The exact electric field profile can be adjusted using the shape of the metal cover 22. In FIG. 12A, it is important that the spacing between the anode 14 and the metal cover 22 be sufficiently large so that no vacuum arc is initiated when the cover 22 is electrically grounded.

In FIG. 12B, to initiate a vacuum arc between the anode 14 and cathode 16, switch $S_1$ can be connected to a trigger voltage, $V_T$, having the same polarity as V, with the exact trigger voltage generally being on the order of V or less. This substantially reduces a voltage difference between the anode 14 and cover 22, thereby substantially reducing the electric field between the anode 14 and cover 22. At the same time, the electric field is substantially increased between the anode 14 and cathode 16 to initiate the vacuum arc.

Additionally, the trigger voltage, $V_T$, provides an electric field bias between the metal cover 22 and a plurality of carbon nanotubes 40 which are electrically grounded through resistor $R_3$. In FIG. 12A, the cover 22 and carbon nanotubes 40 were both electrically grounded so that no electron emission from the carbon nanotubes 40 was stimulated by the metal cover 22. Once the cover 22 is electrically biased to $V_T$, an electric field emission of electrons from the carbon nanotubes 40 is stimulated, with these electrons being emitted into the evacuated region 24 to assist in initiation of the vacuum arc. Once the vacuum arc is initiated between the anode 14 and cathode 16, the electrical energy stored in the capacitor $C_1$ is discharged into the load. A portion of the electrical current in the vacuum arc can flow through the metal cover 22; and this can be advantageous to prevent surface breakdown upon repeated operation of the vacuum switch 10.

In other embodiments of the present invention, the switch $S_1$ can be used to provide an open circuit to trigger initiation of the vacuum arc. In these embodiments, opening the switch $S_1$ allows the metal cover 22 to electrically float, thereby reducing the electric field between the anode 14 and the metal cover 22, and increasing the electric field between the anode 14 and cathode 16 to initiate the vacuum arc. The increased electric field between the anode 14 and cathode 16 can further generate a field emission of electrons from the carbon nanotubes 40 into the evacuated region 24 to assist in initiation of the vacuum arc. One or more channels 38 can also be optionally provided in the device 10 of FIGS. 11 and 12A, 12B between the anode 14 and the cathode 16 to reduce the possibility for surface breakdown.

Figure 12C:
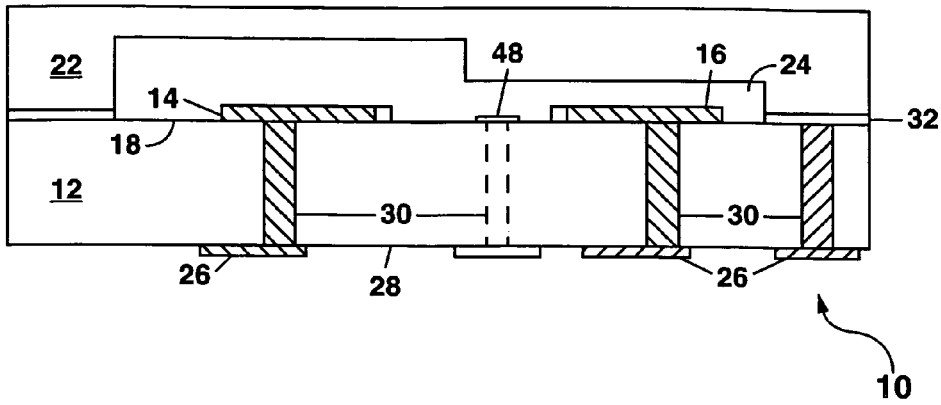
FIG. 12C shows a schematic cross-section view of the device of FIG. 11 with a diamond-like material substituted for the carbon nanotubes therein.

Although the carbon nanotubes 40 in FIGS. 12A and 12B are shown vertically oriented, the carbon nanotubes 40 can be horizontally or randomly oriented in other embodiments of the present invention. Additionally, a layer 48 of a diamond-like material as previously described can be substituted for the carbon nanotubes to provide the electron emission to assist in initiating the vacuum arc. This is schematically illustrated in the cross-section view of FIG. 12C taken along the section line 6-6 in FIG. 11 with the layer 48 of the diamond-like material being substituted for the carbon nanotubes 40. The diamond-like material can be either deposited directly on the substrate 12 as shown in FIG. 12C with a rectangular or arbitrary shape. Alternately the diamond-like material can be deposited over an electrically-conductive layer 42 (e.g. comprising carbon) with substantially the same size as the layer 42 or as localized portions aligned between the teeth 36 on the anode 14 and cathode 16 similar to the localization of the carbon nanotubes 40 shown in FIG. 11. The layer 48 of the diamond-like material can be, for example, on the order of 1 μm thick; and can be doped (e.g. with boron) to provide a negative electron affinity. In other embodiments of the present invention, the carbon nanotubes 40 (or the diamond-like material substituted for the carbon nanotubes 40) can be directly connected to the cathode 16, or can be provided directly on the cathode 16.

The vacuum environment in the device 10 of the present invention allows the device 10 to be used for certain applications where ionizing radiation may be present. For such applications, the provision of a fill gas in the region 24 is not suitable since the fill gas could be ionized by the radiation, thereby leading to a premature switching of the device 10.

The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical vacuum switch apparatus, comprising:
(a) a substrate;
(b) an anode and a cathode spaced apart on a surface of the substrate;
(c) a trigger electrode disposed between the anode and the cathode; and
(d) a cover sealed over the substrate to provide an evacuated region wherein the anode, the cathode and the trigger electrode are exposed to a vacuum environment.

2. The apparatus of claim 1 further comprising at least one channel extending below the surface of the substrate between the anode and the cathode.

3. The apparatus of claim 1 wherein the substrate comprises an electrically-insulating material selected from the group consisting of glass, silica, quartz, diamond, alumina and ceramic.

4. The apparatus of claim 1 wherein the substrate comprises silicon, with an electrically-insulating layer being provided over an upper surface of the silicon substrate beneath the anode and the cathode.

5. The apparatus of claim 1 wherein the anode and the cathode comprise a metal selected from the group consisting of niobium, molybdenum, copper, tungsten, aluminum and alloys thereof.

6. The apparatus of claim 1 wherein the trigger electrode comprises carbon.

7. The apparatus of claim 1 wherein the trigger electrode comprises a spark gap.

8. The apparatus of claim 1 wherein the trigger electrode comprises a plurality of carbon nanotubes.

9. The apparatus of claim 1 wherein the trigger electrode comprises graphitic carbon or a diamond-like material.

10. The apparatus of claim 1 further comprising a plurality of electrical vias extending through the substrate to connect the anode, the cathode and the trigger electrode on one side of the substrate to electrical contacts on an opposite side of the substrate.

11. The apparatus of claim 1 wherein the trigger electrode has a notched shape.

12. The apparatus of claim 11 wherein the anode and the cathode each have a notched shape on a side thereof proximate to the trigger electrode.

13. The apparatus of claim 1 wherein the cover comprises a metal or metal alloy.

14. An electrical vacuum switch apparatus, comprising:
(a) an electrically-insulating substrate;
(b) an anode and a cathode spaced apart on a top side of the substrate;
(c) a trigger electrode disposed on the top side of the substrate between the anode and the cathode;
(d) a plurality of channels extending into the substrate on the top side thereof between the anode and the trigger electrode, and between the cathode and the trigger electrode, with the channels at least partially surrounding the anode and the cathode; and (e) a cover sealed over the top side of the substrate to provide an evacuated region wherein the anode, the cathode and the trigger electrode are located.

15. The apparatus of claim 14 further comprising a plurality of electrically-conducting vias formed through the substrate to electrically connect the anode, the cathode and the trigger electrode to contacts formed on a bottom side of the substrate.

16. The apparatus of claim 14 wherein the anode and the cathode comprise a metal selected from the group consisting of niobium, molybdenum, copper, tungsten, aluminum, and alloys thereof.

17. The apparatus of claim 14 wherein the trigger electrode comprises carbon.

18. The apparatus of claim 14 wherein the substrate comprises an electrically-insulating material selected from the group consisting of glass, silica, quartz, diamond, alumina and ceramic.

19. The apparatus of claim 14 wherein the substrate comprises silicon, with an electrically-insulating layer being provided over an upper surface of the silicon substrate beneath the anode and the cathode.

20. The apparatus of claim 14 wherein the trigger electrode comprises a spark gap.

21. The apparatus of claim 14 wherein the cover comprises a metal or metal alloy.

22. An electrical vacuum switch apparatus, comprising:

(a) a substrate;

(b) an anode and a cathode spaced apart on a surface of the substrate; and (c) a metal cover sealed over the substrate to provide an evacuated region wherein the anode and the cathode are contained in a vacuum environment, with the metal cover forming a trigger electrode to initiate an electrical discharge between the anode and the cathode.

23. The apparatus of claim 22 wherein the metal cover forms a part of a conduction path for the discharge between the anode and the cathode.

24. The apparatus of claim 22 further comprising at least one channel extending below the surface of the substrate between the anode and the cathode.

25. The apparatus of claim 22 wherein the substrate comprises an electrically-insulating material selected from the group consisting of glass, silica, quartz, diamond, alumina and ceramic.

26. The apparatus of claim 22 wherein the substrate comprises silicon, with an electrically-insulating layer being provided over an upper surface of the silicon substrate beneath the anode and the cathode.

27. The apparatus of claim 22 wherein the anode and the cathode comprise a metal selected from the group consisting of niobium, molybdenum, copper, tungsten, aluminum, and alloys thereof.

28. The apparatus of claim 22 wherein the metal cover comprises a metal selected from the group consisting of niobium, molybdenum, copper, tungsten, aluminum and alloys thereof.

29. The apparatus of claim 22 further comprising a plurality of carbon nanotubes located between the anode and the cathode to provide an electron emission to assist in initiating the electrical discharge between the anode and the cathode.

30. The apparatus of claim 22 further comprising a diamond-like material located between the anode and the cathode to provide an electron emission to assist in initiating the electrical discharge between the anode and the cathode.

* * * * *